US010842287B1

(12) United States Patent
Vigil

(10) Patent No.: US 10,842,287 B1
(45) Date of Patent: Nov. 24, 2020

(54) VENTILATED ERGONOMIC BED MATTRESS

(71) Applicant: Randy C Vigil, Dulce, NM (US)

(72) Inventor: Randy C Vigil, Dulce, NM (US)

( * ) Notice: Subject to any disclaimer, the term of this patent is extended or adjusted under 35 U.S.C. 154(b) by 162 days.

(21) Appl. No.: 16/253,317

(22) Filed: Jan. 22, 2019

(51) Int. Cl.
*A47C 21/04* (2006.01)
*A47C 27/14* (2006.01)

(52) U.S. Cl.
CPC ..... *A47C 21/044* (2013.01); *A47C 27/146* (2013.01)

(58) Field of Classification Search
CPC ... A47C 21/044; A47C 27/146; A47C 27/142; A47C 20/026; A47C 20/025; A47C 27/14; A47C 27/15; A47C 27/148; A47C 20/00; A47C 31/00; A47G 9/1054
See application file for complete search history.

(56) References Cited

U.S. PATENT DOCUMENTS

| | | | | | |
|---|---|---|---|---|---|
| 2,244,435 | A | | 6/1941 | John | |
| 2,990,558 | A | * | 7/1961 | Engel | A47C 20/026 5/725 |
| 3,808,615 | A | * | 5/1974 | Geary | A47C 19/045 5/622 |
| 4,025,974 | A | * | 5/1977 | Lea | A47C 27/084 5/709 |
| 5,369,824 | A | | 12/1994 | Powell | |
| 5,426,798 | A | | 6/1995 | Guarino | |
| 5,509,153 | A | * | 4/1996 | Roschacher | A47C 20/025 5/707 |
| 6,546,576 | B1 | | 4/2003 | Lin | |
| 7,661,163 | B1 | * | 2/2010 | Gallaher | A47C 20/021 5/632 |
| 7,913,332 | B1 | | 3/2011 | Barnhart | |
| 8,468,628 | B1 | * | 6/2013 | Cheng | A47G 9/007 5/641 |
| D693,147 | S | | 11/2013 | Henderson | |
| 9,386,859 | B2 | * | 7/2016 | Schultz | A47C 27/15 |
| 10,159,365 | B2 | * | 12/2018 | Wagner | A47G 9/1063 |
| 2006/0101577 | A1 | | 5/2006 | Lussier | |
| 2018/0042409 | A1 | * | 2/2018 | Johnson | A61G 13/121 |

FOREIGN PATENT DOCUMENTS

| | | | | |
|---|---|---|---|---|
| DE | 20119050 U | | 2/2002 | |
| WO | WO-0013553 A1 | * | 3/2000 | A47G 9/1063 |

* cited by examiner

*Primary Examiner* — Eric J Kurilla
*Assistant Examiner* — James T Coble
(74) *Attorney, Agent, or Firm* — Kyle A. Fletcher, Esq.

(57) ABSTRACT

The ventilated ergonomic bed mattress is adapted for use by a client. The ventilated ergonomic bed mattress is a cushion used by the client for sleeping. The ventilated ergonomic bed mattress is constructed such that the client can sleep on the ventilated ergonomic bed mattress such that the anterior side of the client is proximal to the ventilated ergonomic bed mattress. Stated less formally, the ventilated ergonomic bed mattress allows a client to sleep face down. The ventilated ergonomic bed mattress comprises a mattress structure and a plurality of chambers. The mattress structure forms the cushion on which the client rests. The plurality of chambers is a collection of negative spaces formed in the mattress structure used to accommodate the head and the plurality of appendages of the client.

19 Claims, 3 Drawing Sheets

VENTILATED ERGONOMIC BED MATTRESS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture such as beds, more specifically, a stuffed mattress formed with a foam material inlay. (A47C27/14)

SUMMARY OF INVENTION

The ventilated ergonomic bed mattress is adapted for use by a client. The ventilated ergonomic bed mattress is a cushion used by the client for sleeping. The ventilated ergonomic bed mattress is constructed such that the client can sleep on the ventilated ergonomic bed mattress such that the anterior side of the client is proximal to the ventilated ergonomic bed mattress. Stated less formally, the ventilated ergonomic bed mattress allows a client to sleep face down. The ventilated ergonomic bed mattress comprises a mattress structure and a plurality of chambers. The mattress structure forms the cushion on which the client rests. The plurality of chambers is a collection of negative spaces formed in the mattress structure used to accommodate the head and the plurality of appendages of the client.

These together with additional objects, features and advantages of the ventilated ergonomic bed mattress will be readily apparent to those of ordinary skill in the art upon reading the following detailed description of the presently preferred, but nonetheless illustrative, embodiments when taken in conjunction with the accompanying drawings.

In this respect, before explaining the current embodiments of the ventilated ergonomic bed mattress in detail, it is to be understood that the ventilated ergonomic bed mattress is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ventilated ergonomic bed mattress.

It is therefore important that the claims be regarded as including such equivalent construction insofar as they do not depart from the spirit and scope of the ventilated ergonomic bed mattress. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
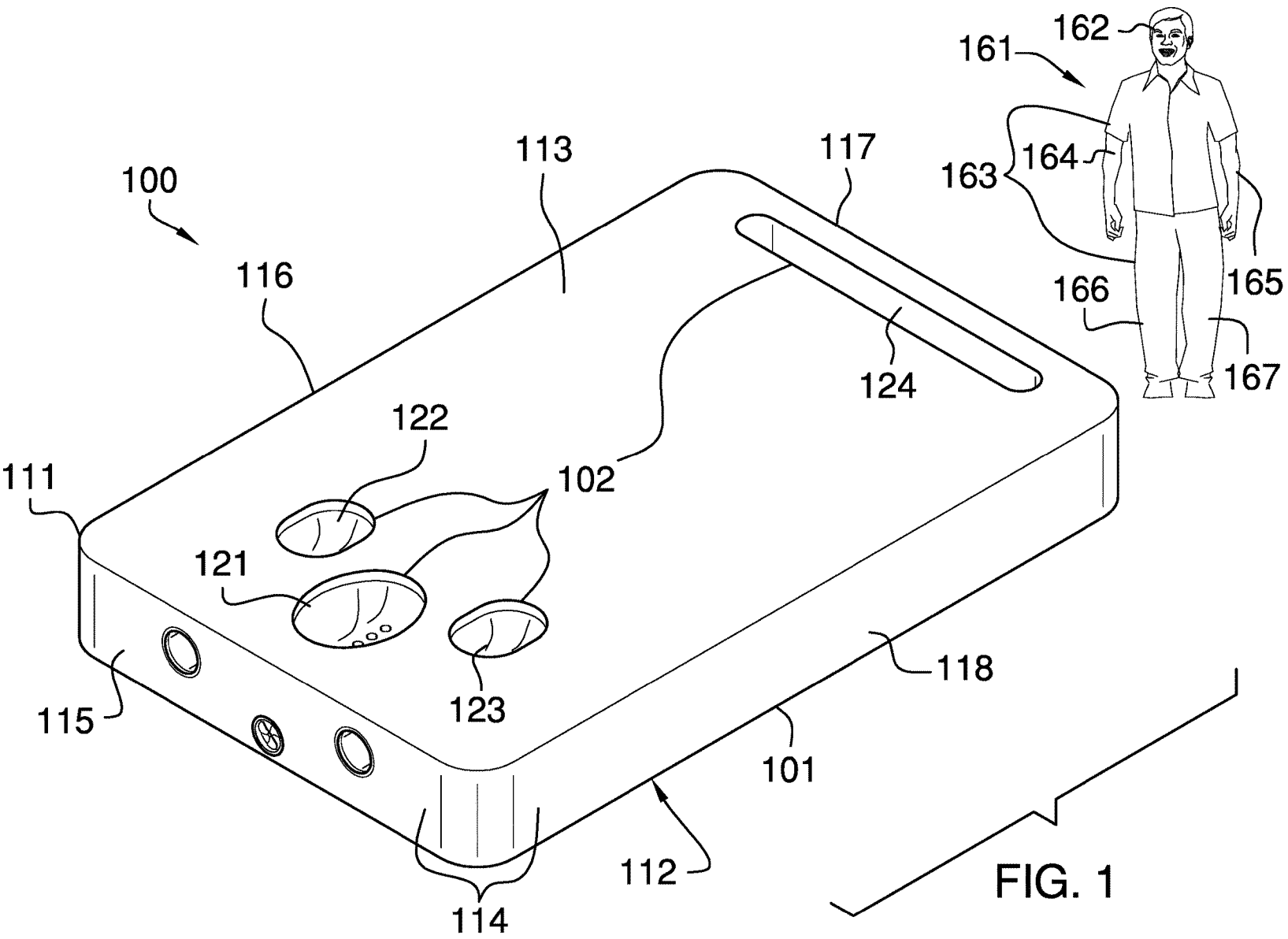
FIG. 1 is a perspective view of an embodiment of the disclosure.
Figure 3:
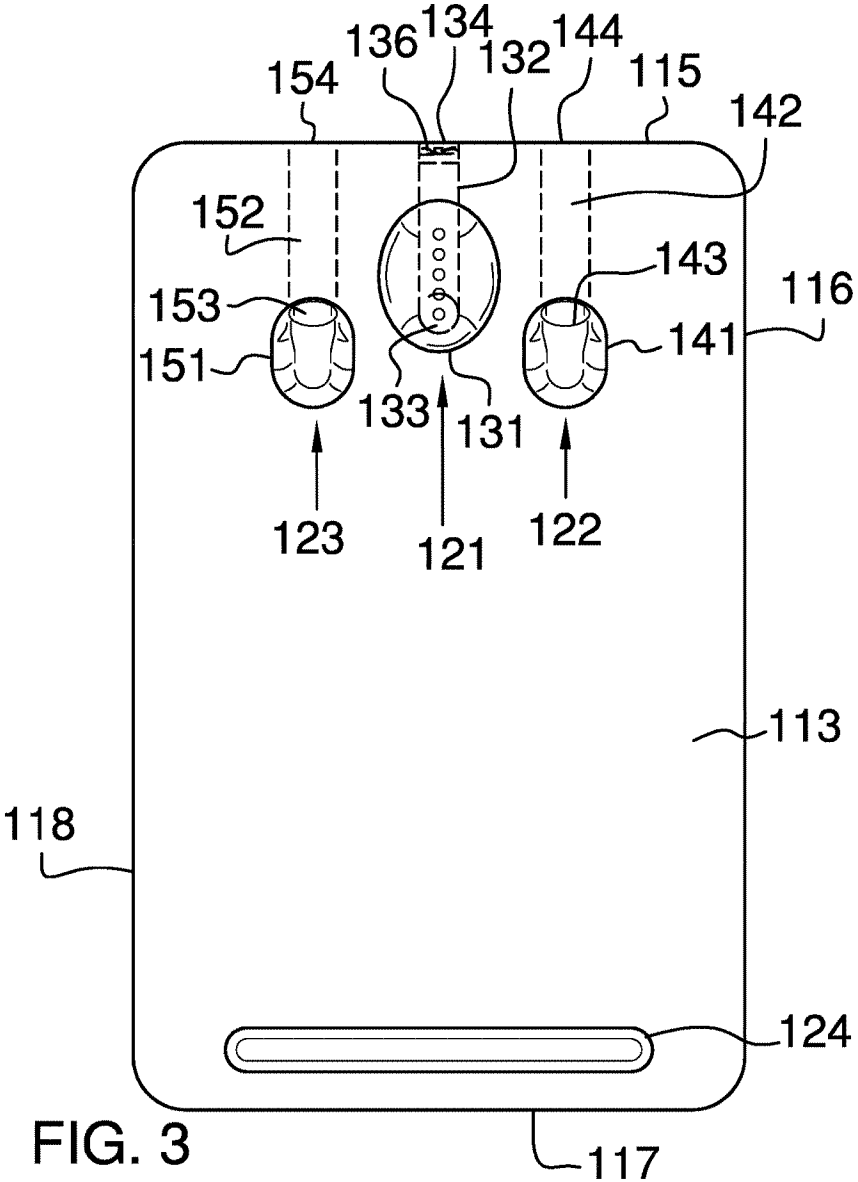
FIG. 3 is a top view of an embodiment of the disclosure.
Figure 2:
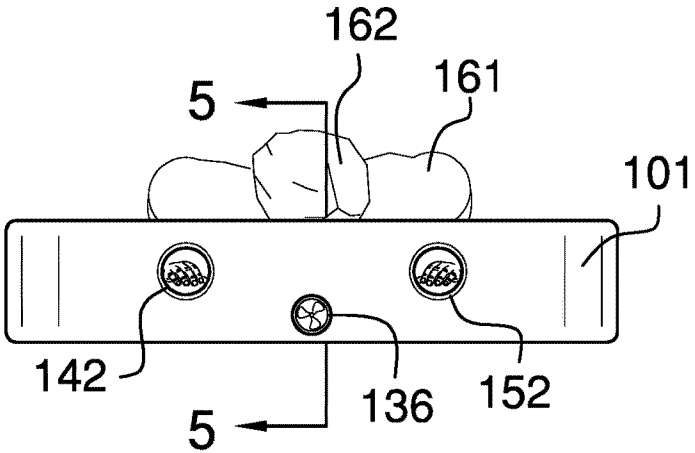
FIG. 2 is a front view of an embodiment of the disclosure.
Figure 4:
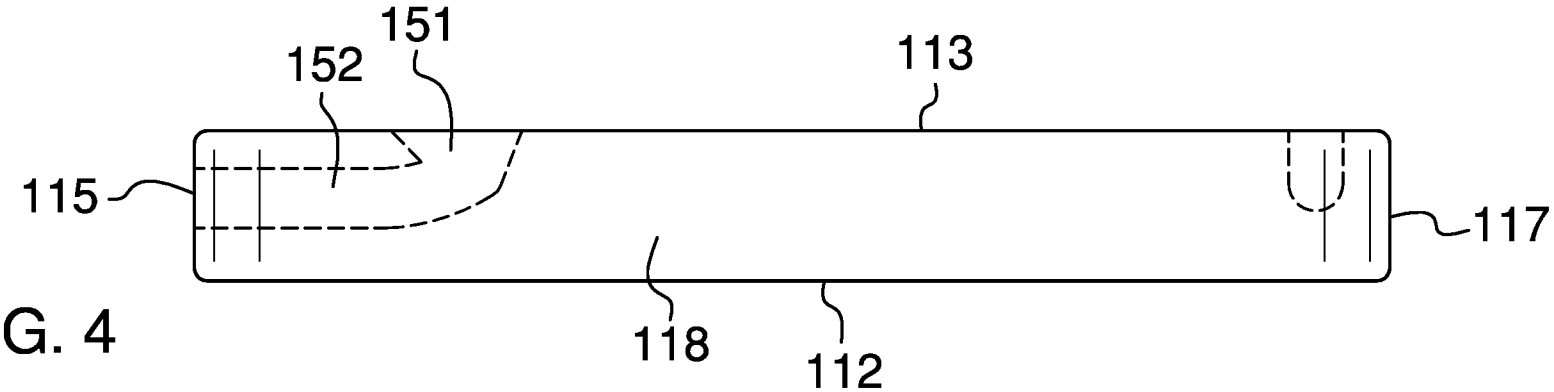
FIG. 4 is a side view of an embodiment of the disclosure.
Figure 5:
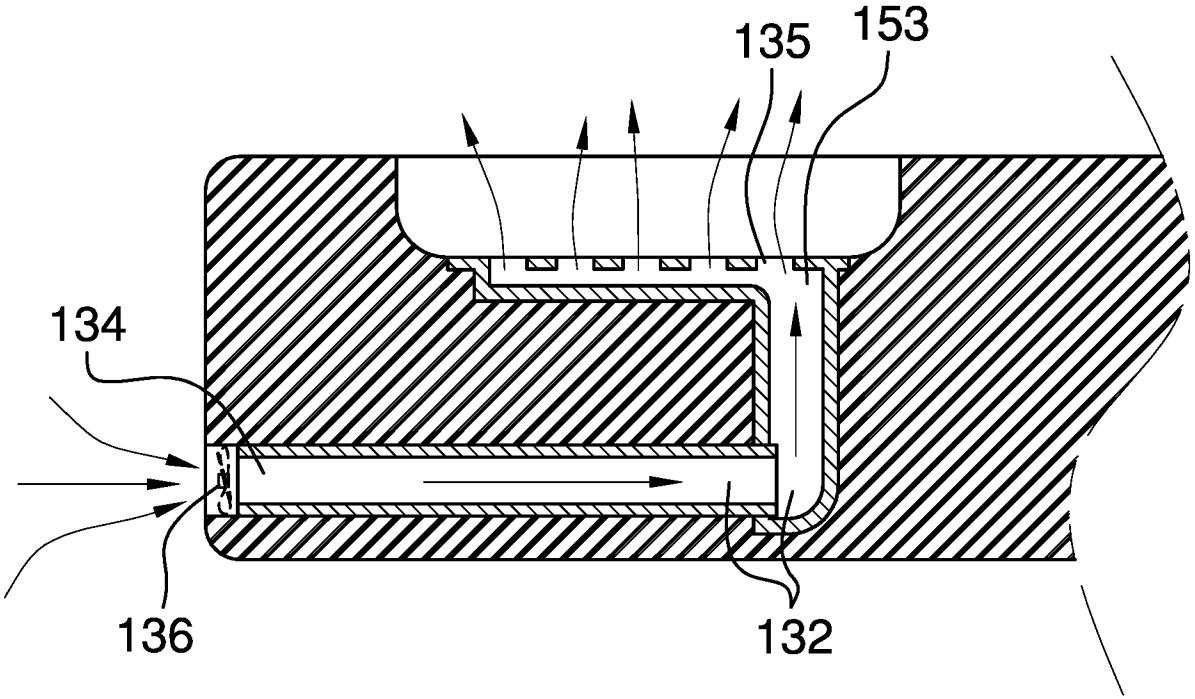
FIG. 5 is a cross-sectional view of an embodiment of the disclosure across 5-5 as shown in FIG. 2.

Detailed reference will now be made to one or more potential embodiments of the disclosure, which are illustrated in FIGS. 1 through 5.

The ventilated ergonomic bed mattress 100 (hereinafter invention) is adapted for use by a client 161. The invention 100 is a cushion used by the client 161 for sleeping. The invention 100 is constructed such that the client 161 can sleep on the invention 100 such that the anterior side of the client is proximal to the invention 100. Stated less formally, the invention 100 allows a client 161 to sleep face down. The invention 100 comprises a mattress structure 101 and a plurality of chambers 102. The mattress structure 101 forms the cushion on which the client 161 rests. The plurality of chambers 102 is a collection of negative spaces formed in the mattress structure 101 used to accommodate a head 162 and a plurality of appendages 163 of the client 161.

The mattress structure 101 is a cushion commonly used by a client 161 for sleeping. The mattress structure 101 is based on a structure that is well-known and documented in our society. The mattress structure 101 comprises an elastomeric disk 111.

The elastomeric disk 111 is an elastomeric structure. The elastomeric disk 111 forms the physical structure of the invention 100. The elastomeric disk 111 supports the client 161. The elastomeric disk 111 forms a cushion on which the client 161 rests. The elastomeric disk 111 has a disk shape. The client 161 rests on one of the congruent ends of the elastomeric disk 111. In the first potential embodiment of the disclosure, the elastomeric disk 111 has a rounded rectangular block shape. The elastomeric disk 111 is formed from a polyurethane foam. The elastomeric disk 111 further comprises an anterior face 112, a posterior face 113, and a plurality of lateral faces 114.

The anterior face 112 is a congruent end of the disk structure of the elastomeric disk 111. The anterior face 112 is a horizontally oriented structure during normal use. The anterior face 112 is the congruent end of the elastomeric disk 111 that rests on a supporting surface.

The posterior face 113 is a congruent end of the disk structure of the elastomeric disk 111. The posterior face 113 is a horizontally oriented structure during normal use. The posterior face 113 is the congruent end of the elastomeric disk on which the client 161 rests. The anterior face 112 is distal from the posterior face 113. Each of the plurality of chambers 102 form apertures through the posterior face 113.

Each of the plurality of lateral faces 114 are vertically oriented structures that attach the anterior face 112 to the posterior face 113. The plurality of lateral faces 114 further comprises a superior lateral face 115, a dexter lateral face 116, an inferior lateral face 117, and a sinister lateral face 118.

The superior lateral face 115 is the lateral face selected from the plurality of lateral faces 114 that is proximal to the head 162 of the client 161 during normal use. The dexter lateral face 116 is the lateral face selected from the plurality of lateral faces 114 that is proximal to the dexter arm 164 of the client 161 during normal use. The inferior lateral face 117 is the lateral face selected from the plurality of lateral faces 114 that is distal from the head 162 of the client 161 during normal use. The sinister lateral face 118 is the lateral face selected from the plurality of lateral faces 114 that is proximal to the sinister arm 165 of the client 161 during normal use. The inferior lateral face 117 is distal from the superior lateral face 115. The sinister lateral face 118 is distal from the dexter lateral face 116.

Each of the plurality of chambers 102 is a negative space that is formed within the mattress structure 101. Each of the plurality of chambers 102 is adapted to receive a portion of the client 161 selected from the group consisting of: a) the head 162 of the client 161; and, b) one or more appendages selected from the plurality of appendages 163 of the client 161. The plurality of chambers 102 are positioned on the posterior face 113 of the mattress structure 101 such that the client 161 sleeps face down on the mattress structure 101. By face down is meant that the anterior side of the client 161 is proximal to the posterior face 113 of the mattress structure 101. The plurality of chambers 102 comprises a head 162 chamber 121, a dexter arm 164 chamber 122, a sinister arm 165 chamber 123, and a slot 124.

The head 162 chamber 121 is a negative space structure that is formed in the elastomeric disk 111. The shape of the head chamber 121 is adapted for use with the head 162 of the client 161. Specifically, the head 162 chamber 121 receives the head 162 while the client 161 is sleeping. The head 162 chamber 121 is a mechanically ventilated structure such that the head 162 of the client 161 has access to fresh air during sleep. The head 162 chamber 121 further comprises a face cavity 131, a face channel 132, and a fan 136.

The face cavity 131 is a negative space that is formed through and into the posterior face 113 of the elastomeric disk 111. The face cavity 131 is sized to receive the head 162 of the client 161 while the client 161 is sleeping. The face cavity 131 further comprises a mesh sheeting 135. The mesh sheeting 135 is a mechanical structure that encloses the proximal HC aperture 133. The mesh sheeting 135 prevents the fan 136 from blowing detritus onto the head 162 of the client 161.

The face channel 132 is an enclosed negative space formed in the interior of the elastomeric disk 111. The face channel 132 forms a fluidic connection between the superior lateral face of the elastomeric disk 111 and the face cavity 131 of the head 162 chamber 121. The face channel 132 forms a duct that allows air to flow into and out of the face cavity 131.

The face channel 132 further comprises a proximal HC aperture 133 and a distal HC aperture 134. The proximal HC aperture 133 is an open end of the duct structure of the face channel 132 that fluidically connects with the face cavity 131. The distal HC aperture 134 is an open end of the duct structure of the face channel 132 that fluidically connects with the atmosphere through the superior lateral face 115 of the elastomeric disk 111.

The fan 136 is a mechanical device that generates a pressure differential used for transporting air from the distal HC aperture 134 through the face channel 132 and the proximal HC aperture 133 into the face cavity 131.

The dexter arm 164 chamber 122 is a negative space structure that is formed in the elastomeric disk 111. The shape of the dexter arm 164 chamber 122 is adapted for use with the dexter arm 164 of the client 161. Specifically, the dexter arm 164 chamber 122 receives the dexter arm 164 while the client 161 is sleeping. The dexter arm 164 chamber 122 further comprises a dexter shoulder cavity 141 and a dexter arm 164 channel 142.

The dexter shoulder cavity 141 is a negative space that is formed through and into the posterior face 113 of the elastomeric disk 111. The dexter shoulder cavity 141 is sized to receive the dexter arm 164 of the client 161 while the client 161 is sleeping.

The dexter arm 164 channel 142 is an enclosed negative space formed in the interior of the elastomeric disk 111. The dexter arm 164 channel 142 forms a fluidic connection between the superior lateral face 115 of the elastomeric disk 111 and the dexter shoulder cavity 141 of the dexter arm 164 chamber 122. The dexter arm 164 channel 142 forms a duct that allows air to flow into and out of the dexter shoulder cavity 141.

The dexter arm 164 channel 142 further comprises a proximal DAC aperture 143 and a distal DAC aperture 144. The proximal DAC aperture 143 is an open end of the duct structure of the dexter arm 164 channel 142 that fluidically connects with the dexter shoulder cavity 141. The distal DAC aperture 144 is an open end of the duct structure of the dexter arm 164 channel 142 that fluidically connects with the atmosphere through the superior lateral face 115 of the elastomeric disk 111.

The sinister arm 165 chamber 123 is a negative space structure that is formed in the elastomeric disk 111. The shape of the sinister arm 165 chamber 123 is adapted for use with the sinister arm 165 of the client 161. Specifically, the sinister arm 165 chamber 123 receives the sinister arm 165 while the client 161 is sleeping. The sinister arm 165 chamber 123 further comprises a sinister shoulder cavity 151 and a sinister arm 165 channel 152. The sinister shoulder cavity 151 is a negative space that is formed through and into the posterior face 113 of the elastomeric disk 111. The sinister shoulder cavity 151 is sized to receive the sinister arm 165 of the client 161 while the client 161 is sleeping.

The sinister arm 165 channel 152 is an enclosed negative space formed in the interior of the elastomeric disk 111. The sinister arm 165 channel 152 forms a fluidic connection between the superior lateral face 115 of the elastomeric disk 111 and the sinister shoulder cavity 151 of the sinister arm 165 chamber 123. The sinister arm 165 channel 152 forms a duct that allows air to flow into and out of the sinister shoulder cavity 151.

The sinister arm 165 channel 152 further comprises a proximal SAC aperture 153 and a distal SAC aperture 154. The proximal SAC aperture 153 is an open end of the duct structure of the sinister arm 165 channel 152 that fluidically connects with the sinister shoulder cavity 151. The distal SAC aperture 154 is an open end of the duct structure of the sinister arm 165 channel 152 that fluidically connects with the atmosphere through the superior lateral face 115 of the elastomeric disk 111.

The slot 124 is a negative space structure that is formed in the elastomeric disk 111. The slot 124 forms a cavity. The shape of the slot 124 is adapted for use with the extremities of both the dexter leg 166 of the client 161 and the sinister leg 167 of the client 161. Specifically, the slot 124 receives the extremities of the dexter leg 166 and the sinister leg 167 while the client 161 is sleeping.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

And/Or: As used in this disclosure, the term and/or is a grammatical conjunction that implies the logical function known as the inclusive or. Specifically, the term and/or implies that at least one and potentially more than one of the plurality of statements joined by the and/or conjunction will be true.

Anterior: As used in this disclosure, anterior is a term that is used to refer to the front side or direction of a structure. When comparing two objects, the anterior object is the object that is closer to the front of the structure. The anterior side of an individual is the face side.

Aperture: As used in this disclosure, an aperture is a prism-shaped negative space that is formed completely through a structure or the surface of a structure.

Appendage: As used in this disclosure, appendage is a generic term used to describe either the arm and/or leg of a client or patient.

Atmosphere: As used in this disclosure, the atmosphere refers to a blanket of gases (primarily nitrogen and oxygen) that surround the earth. Typical atmospheric conditions are approximated and characterized as the normal temperature and pressure. Atmospheric gases are commonly called air.

Carbamate: As used in this disclosure, a carbamate is a functional group consisting of an O—(C=O)—N structure. Carbamate is informally referred to as urethane.

Cavity: As used in this disclosure, a cavity is an empty space or negative space that is formed within an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a tubular passage through which an object or fluid is passed through.

Client: As used in this disclosure, a client is an individual who is designated to receive the services of the disclosure at bar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Copolymer: As used in this disclosure, a copolymer is a polymer formed from two or more repeating molecules (also referred to as monomers).

Coronal Plane: As used in this disclosure, the coronal plane refers to a reference plane that bisects an anterior surface and posterior surface. The coronal plane is also referred to as the lateral plane.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a pad or pillow formed from a soft material that is used for resting, sleeping, or reclining.

Detritus: As used in this disclosure, detritus refers to an accumulation of unwanted material on a surface.

Dexter: As used in this disclosure, dexter is a directional reference that refers to the right side of the body or the right side of an object from the perspective of a viewer who is facing the posterior side of the object.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Distal: As used in this disclosure, distal refers to a directional sense or location of the body. Specifically, distal refers to a first object or a side of a first object that is distal from the medial axis or more proximal to from the side of the body relative to a second object or side of a second object.

Duct: As used in this disclosure, a duct is a tube, pipe, canal or channel through which air is conducted or conveyed.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Extremity: As used in this disclosure, extremity is a generic term used to describe either the hand and/or foot of a person. The extremity is located and the distal end of an appendage.

Fan: As used in this disclosure, a fan is a pump that moves a gas. The first potential embodiment of this disclosure assumes that the fan is a mechanical device with rotating blades that are used to create a flow or current of a gas.

Foam: As used in this disclosure, a foam is a mass of gas-filled spaces, commonly referred to as bubbles, which can be formed: 1) on or in a liquid or gel; or, 2) in a solid material.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, inferior refers to a directional sense or location of the body. Specifically, inferior refers to an object or a side of an object that is proximal to the feet or distal from the head of the body.

Lateral: As used in this disclosure, lateral refers to a directional sense or location of the body. Specifically, lateral refers to an object or a side of an object that is proximal to the side that is distal from the medial axis of the body.

Medial: As used in this disclosure, medial refers to a directional sense or location of the body. Specifically, medial refers to a first object or a side of a first object that is closer to the medial axis or more distal from the side of the body relative to a second object or side of a second object.

Medial Axis: As used in this disclosure, the medial axis is the center line of the body as the line is drawn from the head to the foot. When two objects are compared relative to the medial axis, the object closer to the medial axis is referred to as the medial object and the object distal from the medial axis is referred to as the lateral object.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

Monomer: As used in this disclosure, a monomer refers to a molecular structure that bonds to itself in a repeating manner to form a polymer.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Polymer: As used in this disclosure, a polymer refers to a molecular chain that comprises multiple repeating units known as monomers. The repeating unit may be an atom or a molecular structure.

Polyurethane: As used in this disclosure, polyurethane is a copolymer wherein the one or more monomer chains are linked together carbamates.

Posterior: As used in this disclosure, posterior is a term that is used to refer to the side of an object that is distal or in the opposite direction of the anterior side. When comparing two items, the posterior item is the item that is distal from the anterior of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Rectangular Block: As used in this disclosure, a rectangular block refers to a three-dimensional structure comprising six rectangular surfaces (commonly called faces) formed at right angles. Within this disclosure, a rectangular block may further comprise rounded edges and corners.

Relaxed Shape: As used in this disclosure, a structure is considered to be in its relaxed state when no shear, strain, or torsional forces are being applied to the structure.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Sagittal Plane: As used in this disclosure, the sagittal plane refers to a plane that is perpendicular to the both the coronal (or lateral) plane and the transverse plane.

Sheeting: As used in this disclosure, a sheeting is a material, such as a paper, textile, a plastic, or a metal foil, in the form of a thin flexible layer or layers.

Sinister: As used in this disclosure, sinister is a directional reference that refers to the left side of the body or the left side of an object from the perspective of a viewer who is facing the posterior side of the object.

Slot: As used in this disclosure, a slot is a long narrow cavity or aperture that is formed in or through an object.

Superior: As used in this disclosure, superior refers to a directional sense or location of the body. Specifically, superior refers to an object or a side of an object that is distal from the feet or proximal to the head of the body.

Transverse Plane: As used in this disclosure, a transverse plane is a plane that divides an object into a superior section and an inferior section. In a person, the transverse plane would be perpendicular to the medial axis of a body.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ventilated cushion comprising:

a mattress structure and a plurality of chambers;

wherein the plurality of chambers is a collection of negative spaces formed in the mattress structure;

wherein the ventilated cushion is adapted for use by a client;

wherein the ventilated cushion is a cushion used by the client for sleeping;

wherein the ventilated cushion is constructed such that the client can sleep on the ventilated cushion such that the anterior side of the client is proximal to the ventilated cushion;

wherein the mattress structure forms the cushion on which the client rests;

wherein the plurality of chambers accommodate a head and a plurality of appendages of the client;

wherein the mattress structure comprises an elastomeric disk;

wherein the plurality of chambers comprises a head chamber, a dexter arm chamber, a sinister arm chamber, and a slot;

wherein the head chamber is a negative space structure that is formed in the elastomeric disk;

wherein the shape of the head chamber is adapted for use with the head of the client;

wherein the dexter arm chamber is a negative space structure that is formed in the elastomeric disk;

wherein the shape of the dexter arm chamber is adapted for use with the dexter arm of the client;

wherein the sinister arm chamber is a negative space structure that is formed in the elastomeric disk;

wherein the shape of the sinister arm chamber is adapted for use with the sinister arm of the client;

wherein the slot is a negative space structure that is formed in the elastomeric disk;

wherein the shape of the slot is adapted for use with the extremities of both the dexter leg of the client and the sinister leg of the client.

2. The ventilated cushion according to claim 1 wherein the elastomeric disk is an elastomeric structure;

wherein the elastomeric disk forms the physical structure of the ventilated cushion.

3. The ventilated cushion according to claim 2 wherein each of the plurality of chambers is a negative space that is formed within the mattress structure;

wherein each of the plurality of chambers is adapted to receive a portion of the client selected from the group consisting of: a) the head of the client; and, b) one or more appendages selected from the plurality of appendages of the client.

4. The ventilated cushion according to claim 3 wherein the elastomeric disk has a disk shape;

wherein the elastomeric disk is formed from a polyurethane foam;

wherein the client rests on one of the congruent ends of the elastomeric disk.

5. The ventilated cushion according to claim 4 wherein the elastomeric disk further comprises an anterior face, a posterior face, and a plurality of lateral faces;

wherein the anterior face is a congruent end of the disk structure of the elastomeric disk;

wherein the anterior face is a horizontally oriented structure;

wherein the anterior face is the congruent end of the elastomeric disk that rests on a supporting surface;

wherein the posterior face is a congruent end of the disk structure of the elastomeric disk;

wherein the posterior face is a horizontally oriented structure;

wherein the posterior face is the congruent end of the elastomeric disk on which the client rests;

wherein the anterior face is distal from the posterior face;

wherein each of the plurality of lateral faces are vertically oriented structures that attach the anterior face to the posterior face.

6. The ventilated cushion according to claim 5 wherein the plurality of lateral faces further comprises a superior lateral face, a dexter lateral face, an inferior lateral face, and a sinister lateral face;

wherein the superior lateral face is the lateral face selected from the plurality of lateral faces that is proximal to the head of the client;

wherein the dexter lateral face is the lateral face selected from the plurality of lateral faces that is proximal to the dexter arm of the client;

wherein the inferior lateral face is the lateral face selected from the plurality of lateral faces that is distal from the head of the client;

wherein the sinister lateral face is the lateral face selected from the plurality of lateral faces that is proximal to the sinister arm of the client;

wherein the inferior lateral face is distal from the superior lateral face;

wherein the sinister lateral face is distal from the dexter lateral face.

7. The ventilated cushion according to claim 6 wherein each of the plurality of chambers form apertures through the posterior face.

8. The ventilated cushion according to claim 7 wherein the plurality of chambers are positioned on the posterior face of the mattress structure such that anterior side of the client is proximal to the posterior face of the mattress structure.

9. The ventilated cushion according to claim 8 wherein the slot forms a cavity;

wherein the slot receives the extremities of the dexter leg and the sinister leg.

10. The ventilated cushion according to claim 9 wherein the head chamber is a mechanically ventilated structure such that the head of the client has access to fresh air.

11. The ventilated cushion according to claim 10 wherein the head chamber further comprises a face cavity, a face channel, and a fan;

wherein the face cavity is a negative space that is formed through and into the posterior face of the elastomeric disk;

wherein the face cavity is sized to receive the head of the client;

wherein the face channel is an enclosed negative space formed in the interior of the elastomeric disk;

wherein the face channel is a duct that allows air to flow into and out of the face cavity;

wherein the fan is a mechanical device that generates a pressure differential.

12. The ventilated cushion according to claim 11 wherein the face channel forms a fluidic connection between the superior lateral face of the elastomeric disk and the face cavity of the head chamber.

13. The ventilated cushion according to claim 12 wherein the face channel further comprises a proximal HC aperture and a distal HC aperture;

wherein the proximal HC aperture is an open end of the duct structure of the face channel that fluidically connects with the face cavity;

wherein the distal HC aperture is an open end of the duct structure of the face channel that fluidically connects with the atmosphere through the superior lateral face of the elastomeric disk.

14. The ventilated cushion according to claim 13 wherein transports air from the distal HC aperture through the face channel and the proximal HC aperture into the face cavity.

15. The ventilated cushion according to claim 14 wherein the face cavity further comprises a mesh sheeting;

wherein the mesh sheeting is a mechanical structure that encloses the proximal HC aperture.

16. The ventilated cushion according to claim 15 wherein the dexter arm chamber further comprises a dexter shoulder cavity and a dexter arm channel;

wherein the dexter shoulder cavity is a negative space that is formed through and into the posterior face of the elastomeric disk;

wherein the dexter shoulder cavity is sized to receive the dexter arm of the client;

wherein the dexter arm channel is an enclosed negative space formed in the interior of the elastomeric disk;

wherein the dexter arm channel forms a fluidic connection between the superior lateral face of the elastomeric disk and the dexter shoulder cavity of the dexter arm chamber;

wherein the dexter arm channel is a duct that allows air to flow into and out of the dexter shoulder cavity.

17. The ventilated cushion according to claim 16 wherein the dexter arm channel further comprises a proximal DAC aperture and a distal DAC aperture;

wherein the proximal DAC aperture is an open end of the duct structure of the dexter arm channel that fluidically connects with the dexter shoulder cavity;

wherein the distal DAC aperture is an open end of the duct structure of the dexter arm channel that fluidically connects with the atmosphere through the superior lateral face of the elastomeric disk.

18. The ventilated cushion according to claim 17 wherein the sinister arm chamber further comprises a sinister shoulder cavity and a sinister arm channel;

wherein the sinister shoulder cavity is a negative space that is formed through and into the posterior face of the elastomeric disk;

wherein the sinister shoulder cavity is sized to receive the sinister arm of the client while the client is sleeping;

wherein the sinister arm channel is an enclosed negative space formed in the interior of the elastomeric disk;

wherein the sinister arm channel forms a fluidic connection between the superior lateral face of the elastomeric disk and the sinister shoulder cavity of the sinister arm chamber;

wherein the sinister arm channel is a duct that allows air to flow into and out of the sinister shoulder cavity.

19. The ventilated cushion according to claim 18 wherein the sinister arm channel further comprises a proximal SAC aperture and a distal SAC aperture;

wherein the proximal SAC aperture is an open end of the duct structure of the sinister arm channel that fluidically connects with the sinister shoulder cavity;

wherein the distal SAC aperture is an open end of the duct structure of the sinister arm channel that fluidically connects with the atmosphere through the superior lateral face of the elastomeric disk.

* * * * *